US006871613B2

(12) United States Patent
Murray et al.

(10) Patent No.: US 6,871,613 B2
(45) Date of Patent: Mar. 29, 2005

(54) TARNISH-RESISTANT HANDBELL AND ITS METHOD OF MANUFACTURE

(75) Inventors: Philip James Murray, Southampton, PA (US); Russell A. Wenner, Perkiomenville, PA (US); Gregory L. Schwartz, Spinnerstown, PA (US)

(73) Assignee: Schulmerich Carillons, Inc., Sellersville, PA (US)

( * ) Notice: Subject to any disclaimer, the term of this patent is extended or adjusted under 35 U.S.C. 154(b) by 21 days.

(21) Appl. No.: 10/456,719

(22) Filed: Jun. 6, 2003

(65) Prior Publication Data

US 2004/0244671 A1 Dec. 9, 2004

(51) Int. Cl.[7] ..... G10K 1/071
(52) U.S. Cl. ..... 116/148; 116/171
(58) Field of Search ..... 116/148, 25, 171

(56) References Cited

U.S. PATENT DOCUMENTS

| | | | | | |
|---|---|---|---|---|---|
| 234,900 | A | | 11/1880 | Wilson | |
| 236,652 | A | | 1/1881 | Torrey | |
| 1,715,324 | A | | 5/1929 | Haglund | |
| 3,139,855 | A | | 7/1964 | Kunz | 116/171 |
| 3,207,124 | A | | 9/1965 | Malta | 116/171 |
| 3,253,574 | A | | 5/1966 | Malta | 116/171 |
| 4,062,317 | A | | 12/1977 | Malta | 116/171 |
| 4,394,170 | A | * | 7/1983 | Sawaoka et al. | 75/233 |
| 4,566,400 | A | | 1/1986 | Keenan et al. | 116/171 |
| 5,223,460 | A | * | 6/1993 | Dubensky et al. | 501/94 |
| 5,235,893 | A | | 8/1993 | Malta | 84/406 |
| 5,242,753 | A | * | 9/1993 | Sue et al. | 428/336 |
| 5,252,360 | A | * | 10/1993 | Huttl et al. | 427/249.17 |
| 5,458,928 | A | * | 10/1995 | Kiyama et al. | 427/530 |
| 5,783,313 | A | * | 7/1998 | Moysan et al. | 428/627 |
| 5,844,225 | A | * | 12/1998 | Kimock et al. | 235/462.01 |
| 5,879,532 | A | * | 3/1999 | Foster et al. | 205/192 |
| 5,882,778 | A | * | 3/1999 | Sugizaki et al. | 428/216 |
| 6,245,435 | B1 | * | 6/2001 | O'Brien et al. | 428/472 |
| 6,355,202 | B2 | * | 3/2002 | Verdon | 264/430 |

OTHER PUBLICATIONS

Schulmerich Handbells, 4 page brochure, Jun. 2000.
Schulmerich Handbells, MelodyChime® Instruments, & Accessories 2002. 6 page brochure, Jun. 2002.
8 page brochure of Richter Percision Inc., 2002 (month unknown).
Lee, Ph.D., "Decorative Finishing Using PVD", 16$^{th}$ AESF/EPA Conference Proceedings, reprinted on Feb. 1995.
Graves, "PVD Protects and Beautifies", printed (date unknown).

* cited by examiner

*Primary Examiner*—Christopher W. Fulton
*Assistant Examiner*—Amy R. Cohen
(74) *Attorney, Agent, or Firm*—Howson and Howson

(57) ABSTRACT

A handbell has a bell body with an inner surface engageable by a clapper to produce a sound corresponding to a note of the musical scale and an outer surface with a vapor deposited nitride layer that resists tarnish. Preferably, the vapor deposited nitrate layer has a thickness of less than about 5 microns and does not adversely affect the sound produced when the handbell is rung. In addition, preferably the vapor deposited nitrate layer is zirconium nitride or titanium nitride and has a Vickers hardness (HV) of at least 2300. A method of making and/or refurbishing a handbell is also disclosed.

24 Claims, 1 Drawing Sheet

TARNISH-RESISTANT HANDBELL AND ITS METHOD OF MANUFACTURE

FIELD OF THE INVENTION

The present invention relates to a handbell, and more particularly, the present invention relates to a handbell having a bell body that resists tarnish.

BACKGROUND OF THE INVENTION

Handbells are disclosed, for example, in U.S. Pat. Nos. 3,139,855, 3,207,124, 3,253,574, 4,062,317, and 4,566,400. Handbells generally include a bell body, or bell casting, a clapper assembly mounted within the bell body for striking the bell body, and a handle such as a strap used by a player to grasp and play the handbell. The bell body is typically a bronze casting, which is known to provide the most desirable combination of tonal clarity and sustain.

Handbells are carefully manufactured, polished and tuned so that different handbells produce different desired notes of the musical scale so that the handbells can be played in concert by a group of musicians. For example, a set of at least eighty-five handbells may be provided such that each bell produces a different note for notes spanning the first through seventh octaves of the musical scale. The size, weight, and shape of the bell bodies of the handbells vary depending upon the desired musical note to be produced.

It is customary for most players of handbells to wear gloves when playing and handling handbells. This is because the natural oils and/or salts, chemicals or the like that may be present on a player's bare hand that may contact the surface of a bell body, particularly the polished outer surface, can tarnish the surface of the bell body over time (ie., cause undesirable dark spots to appear on the surface of the bell body). In addition, the bell bodies typically require periodic cleaning/polishing/abrading with polishing substances to maintain a desired appearance. The repeated rubbing of the bell body to polish the surface of the bell body can alter the pitch of the sound (ie., flatten the sound) produced by the handbell, at which time the handbell may need to be replaced.

Thus, there is a need for an improved handbell having a bell body, or casting, that resists tarnish and that eliminates the need for polishing with harsh substances. A desirable bell body should resist becoming tarnished even when exposed to chemicals, salts and oils, such as when the bell body is held directly in the player's bare hand. In addition, a desirable bell body should be capable of being cleaned merely by being wiped with a clean, soft cloth without requiring the application of polishing compounds. Further, a desirable bell body should have long-lasting tarnish resistance, and providing the bell with this property should not undesirably alter the sound produced by the handbell. Still further, the tarnish-resistant handbell should be inexpensive to manufacture and maintain. From a manufacturing standpoint, it is also desirable to provide a method of manufacturing new handbells, as well as refurbishing existing handbells, in which the handbells are provided with an anti-tarnish finish.

OBJECTS OF THE INVENTION

With the foregoing in mind, a primary object of the present invention is to provide a handbell having a bell body that is tarnish resistant.

Another object of the present invention is to provide a handbell that is easy to clean and maintain and that is not required to be polished with harsh substances.

A further object of the present invention is to provide a high-quality handbell having long-lasting, tarnish-resistance that does not undesirably alter the sound produced by the handbell.

Still further objects of the present invention are to provide a method of efficiently manufacturing a high-quality handbell that resists tarnish, and a method of refurbishing handbells that includes providing them with an anti-tarnish finish.

SUMMARY OF THE INVENTION

More specifically, the present invention provides a tarnish-resistant handbell having a bell body with an inner surface engageable by a clapper to produce a sound corresponding to a note of the musical scale and an outer surface with a vapor deposited nitride layer. Preferably, the vapor deposited nitride layer resists tarnish and does not adversely affect the sound produced when the handbell is rung. In addition, preferably the vapor deposited nitride layer is zirconium nitride or titanium nitride having stated physical properties.

BRIEF DESCRIPTION OF THE DRAWINGS

The foregoing and other objects, features and advantages of the present invention should become apparent from the following description when taken in conjunction with the accompanying drawing, in which.

DETAILED DESCRIPTION OF THE PREFERRED EMBODIMENT

Figures 1, 2:
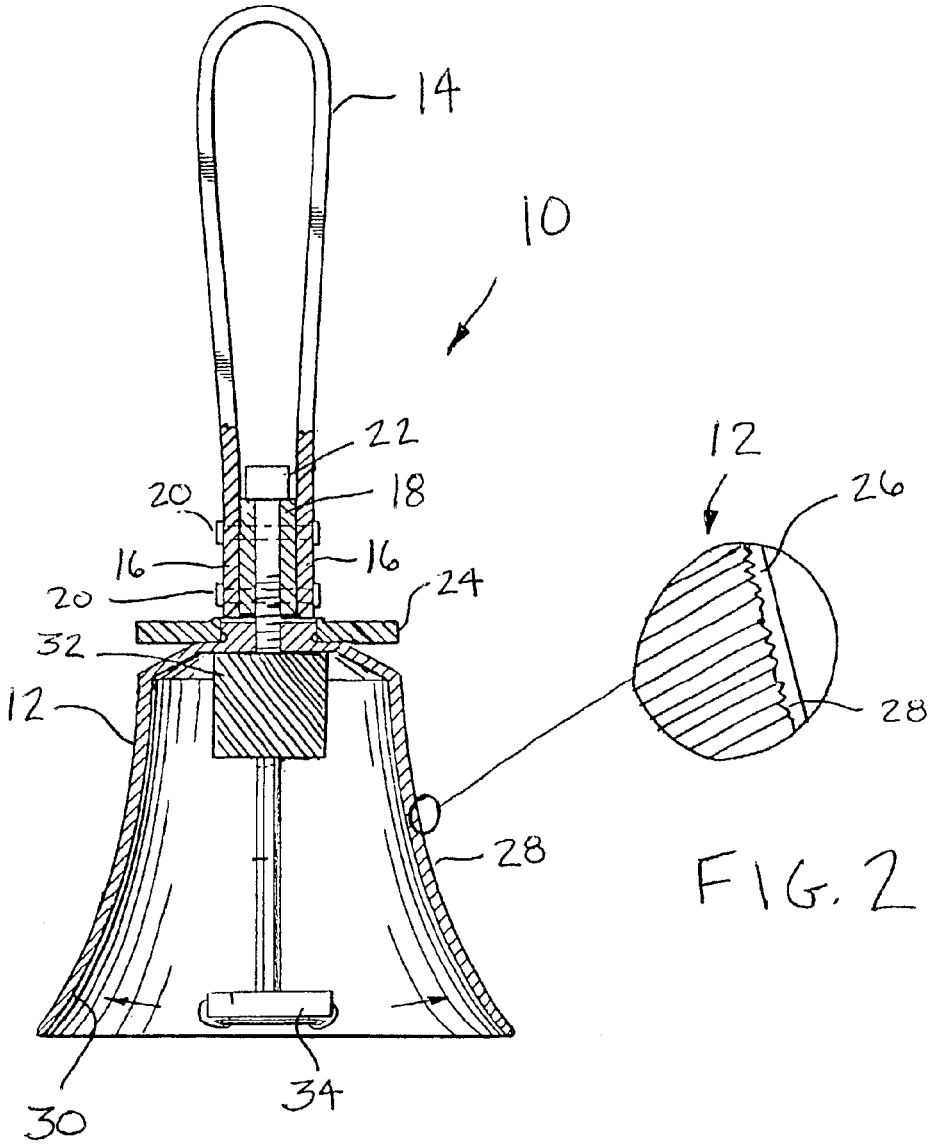
FIG. 1 is a cross-sectional view of a handbell manufactured according to the present invention.
FIG. 2 is an exploded view of a portion of the handbell illustrated in FIG. 1.

A handbell 10 made according to the present invention is illustrated in FIG. 1. The handbell 10 includes a bell body, or bell casting, 12. Typically, the bell body 12 is made of bronze such as a so-called "pure bronze bell metal" that comprises about 80% copper and 20% tin. Alternatively, the bell can be made of other metals, such as aluminum, and other alloys.

The bell body 12 interconnects to a handle 14, such as a strap-style handle having a pair of ends 16 that is secured to a handle block 18 with a set of rivets 20, or the like. A cap screw 22 secures the handle block 18 to a clapper assembly 32 positioned within the bell body 12. The clapper assembly 32 has a clapper 34 that can pivot and strike the inner surface 30 of the bell body 12. A handguard disc 24 extends between the handle 14 and bell body 12 to prevent accidental damping of the bell body 12 by contact of the hand of the player when the bell body 12 is struck during play.

The clapper assembly 32 can be provided in many different forms, such as for instance, those disclosed in the previously cited patents. For example, the clapper assembly can be the same as, or similar to, the clapper assembly disclosed in U.S. Pat. No. 4,062,317 assigned to Schulmerich Carillons, Inc., the assignee of the present application. The disclosure of U.S. Pat. No. 4,062,317 is incorporated herein by reference. The clapper assembly should include a clapper 34 for striking (ie., ringing, playing, etc.) the bell body 12 and a restraining means (not shown in detail) for controlling the swinging movement of the clapper 34 within the bell body 12 so that the clapper contacts the bell body 12 only when a predetermined amount of strike force is applied. This prevents unintentional contact of the bell body 12 by the clapper.

In use, the handle 14 is gripped by the hand of a player, and a musical note is generated when the player causes the clapper 34 to strike the bell body 12. This is typically accomplished when the player twists his/her wrist causing the handbell 10 to pivot and then come to a sudden stop. The force exerted by this movement causes the clapper to pivot relative to the bell body 12 and to strike the bell body 12 thereby producing a sound.

One of the important aspects of the handbell 10 embodying the present invention is the presence of a thin, strong nitride layer, film, coating or the like, 26 that extends continuously on at least an outer surface 28 of the bell body 12. The disclosed nitride layer 26 provides the bell body 12 with an anti-tarnish finish without adversely affecting the tonal qualities of the sound produced when the handbell 10 is played. Preferably, the nitride layer 26 is strongly bonded to the outer surface 28 of the bell body 12, and has high hardness and high abrasion and chemical resistance. Thus, the layer 26 is long lasting and permits the bell body 12 to be cleaned merely by being wiped with a clean, soft cloth without the application of a polishing compound.

Preferably, the nitride layer 26 is deposited on the bell body 12 using known so-called "cool" physical vapor deposition (PVD) techniques to modify the surface of the bell body 12 and to provide it with a tarnish resistant quality. In such a method, a bell body, such as a bronze bell body, is cast and is then placed in a vacuum chamber between a pair of opposed magnetron cathodes. A vacuum is drawn within the chamber, and a gas discharge is created between the pair of opposed magnetron cathodes to generate a highly ionized plasma vapor that concentrates around negatively biased parts of the bell body 12, such as the outer surface 28 of the bell body 12, and some or all of the inner surface 30 of the bell body 12, if desired. Material from a sputtering target is reactively removed, combines with the plasma vapor, and condenses on the bell body which is under constant ion bombardment. This causes a thin film, coating, or layer 26 of the material to condense on the bell body 12 in a controllable manner and to be strongly bonded thereto. The layer 26 is preferably a metal nitride and has a uniform thickness that is preferably less than about 5 microns, and more preferably, within a range of about 0.15 to 1 micron.

Zirconium nitride (ZrN) and titanium nitride (TiN) are each preferred materials for the vapor deposited nitride layer 26 due to the long lasting anti-tarnish finish and color provided, and due to the relatively low processing temperatures at which they can be deposited on the bell body 12. A layer of zirconium nitride provides the outer surface 28 of the bell body 12 with a natural bronze appearance, while a layer of titanium nitride provides a golden surface finish. These materials should be deposited utilizing PVD techniques requiring process temperatures that do not exceed 700° F. To this end, the processing temperature for applying a film of zirconium nitride is typically about 320° F., and the processing temperature for applying a film of titanium nitride is typically about 700° F. Such processing temperatures are significantly below the temperature at which the crystalline structure of a cast bronze bell body begins to change in a way that undesirably alters the tonal qualities of the bell body 12.

The present invention is not limited to a zirconium nitride (ZrN) or a titanium nitride (TiN) layer. To this end, any nitride material can be used provided that it forms a long lasting anti-tarnish finish that can be deposited at process temperatures/times below the temperatures/times that will alter the metallurgical structure of the bell body 12. The layer 26 can be a single layer of ZrN or TiN, or a mixture thereof, or may include other nitrides. Alternatively, multiple layers can be formed of the same or different nitride materials. In addition, in preferred embodiments, the vapor deposited nitride layer 26 has high hardness. For example, the layer should have a hardness, as measured on the Vickers hardness scale (HV) without reference to the substrate on which it is deposited, preferably of at least 2300 HV, and more preferably, within a range of about 2300 to 2500 HV. The layer should have a static coefficient of friction of about 0.35 as measured relative to steel.

While the vapor deposited nitride layer 26 can be as thick as desired, it is preferably of a thickness that will provide a long lasting anti-tarnish finish, yet will not adversely affect the tonal qualities of sounds produced by the bell body 12. To this end, the thickness of the nitride layer 26 is preferably less than about 5 microns for purposes of reducing costs and limiting its affect on the tonal qualities of the bell body 12. More preferably, the thickness of the nitride layer 26 is within a range of about 0.15 to 1 micron. The thickness of the layer 26 should be such that its affect on the sound produced by the bell body 12 is predictable and raises the frequency of sound produced by the bell by a predetermined amount directly related to the thickness of the layer. For example, a thickness of less than about 1 micron should only raise the frequency by about one or two cents (ie., 1/100 to 2/100 of the difference in frequency between two adjacent notes). As a result, this relatively minor and predictable difference can be accommodated during manufacture or tuning of the bell body 12.

In a preferred method of making a new handbell, a bell body is made, such as by casting a bronze bell body, and is tuned to produce a desired sound by removing material from the bell body as is well known in the art. Preferably, the bell body is tuned to a frequency below the ultimately desired frequency by a predetermined amount. The predetermined amount is directly related to the thickness of a nitride layer to be added to the bell body. For example, if the added layer, or coating, will have a thickness of about less than 1 micron, the bell body can be tuned to about 2 cents below the desired frequency.

After the bell body is tuned, a nitride layer is bonded to selected surfaces of the bell body, such as the outer surface of the bell body, by known so-called "cool" PVD techniques. Preferably, the nitride layer is deposited on the bell body at PVD processing temperatures of less than or equal to about 700° F. and at a thickness preferably less than about 5 microns, and more preferably, within a range of about 0.15 to 1 micron. The nitride layer is preferably ZrN or TiN, provides an anti-tarnish finish, and raises the frequency of the sounds produced by the bell body by a relatively small predetermined amount such as less than about 2 cents. Thereafter, a handle and clapper assembly is attached to the bell body to form a handbell capable of producing a sound corresponding to a note of the musical scale. The above method can also be utilized to refurbish existing handbells.

While a preferred handbell and its method of manufacture have been described in detail, various modifications, alterations, and changes may be made without departing from the spirit and scope of the handbell and method according to the present invention as defined in the appended claims.

What is claimed is:

1. A tarnish-resistant handbell, comprising:

a bell body having an inner surface engageable by a clapper to produce a sound, and an outer surface;

at least said outer surface having a vapor deposited nitride layer that resists tarnish without adversely affecting the sound produced when the bell is rung, said vapor deposited-nitride layer having a thickness no greater than about 1 micron.

2. A tarnish-resistant handbell according to claim 1, wherein said body is made of metal.

3. A tarnish-resistant handbell according to claim 2, wherein said metal is bronze.

4. A tarnish-resistant handbell according to claim 2, wherein said body is made of aluminum.

5. A tarnish-resistant handbell according to claim 1, wherein said thickness of said vapor deposited nitride layer is in a range of about 0.15 to 1.0 microns.

6. A tarnish-resistant handbell according to claim 1, wherein said vapor deposited nitride layer has a Vickers hardness (HV) in a range of about 2300 to 2500.

7. A tarnish-resistant handbell according to claim 1, wherein said vapor deposited nitride layer has a static coefficient of friction of about 0.35.

8. A tarnish-resistant handbell according to claim 1, wherein said vapor deposited nitride layer is zirconium nitride.

9. A tarnish-resistant handbell according to claim 1, wherein said vapor deposited nitride layer is titanium nitride.

10. A tarnish-resistant handbell according to claim 1, wherein said vapor deposited nitride layer has a Vickers hardness (HV) greater than about 2300, and a static coefficient of friction of about 0.35.

11. A tarnish-resistant handbell according to claim 10, wherein said nitride layer includes a metal.

12. A tarnish-resistant handbell according to claim 11, wherein said metal includes either zirconium or titanium.

13. A tarnish-resistant handbell, comprising:

a bell body having an inner surface engageable by a clapper to produce a sound corresponding to a note of the musical scale, and an outer surface;

at least said outer surface having a single layer consisting essentially of a vapor deposited nitride layer that resists tarnishing of said outer layer without adversely affecting the sound produced when the bell is rung, said vapor deposited nitride layer being selected from the group consisting of zirconium nitride and titanium nitride, having a thickness of no greater than about 1 micron, and a Vickers hardness (HV) of at least 2300.

14. A tarnish-resistant handbell according to claim 13, wherein said bell body is cast of bronze.

15. A method of providing a handball with an anti-tarnish finish, comprising the step of bonding a thin nitride layer to an outer surface of a bell body utilizing physical vapor deposition (PVD) techniques, said nitride layer being formed such that it has a thickness of no greater than about 1 micron.

16. A method according to claim 15, further comprising the step of tuning the bell body before said bonding step.

17. A method according to claim 16, further comprising the step of casting a bell body of bronze, and wherein said tuning step includes removing material from said cast bell body.

18. A method according to claim 16, wherein during said tuning step, a frequency to which said bell body is tuned is below a desired frequency by a predetermined amount which is directly related to a thickness of said layer.

19. A method according to claim 18, wherein said nitride layer is formed such that it has a uniform thickness of between about 0.15 to about 1 micron and raises the frequency of the bell by no more than about 2 cents.

20. A method according to claim 16, wherein said physical vapor deposition (PVD) includes the steps of placing said bell body in a vacuum chamber between a pair of opposed magnetron cathodes, drawing a vacuum in said chamber, creating a gas discharge between said pair of opposed magnetron cathodes to generate a highly ionized plasma vapor that concentrates around negatively biased parts of said bell body, and reactively removing a material from a sputtering target that combines with said plasma vapor and condenses on said bell body as said bell body is under constant ion bombardment.

21. A method according to claim 16, further comprising the steps of removing a handle and clapper assembly from an existing handbell before said bonding step so that said bell body can be refurbished.

22. A method according to claim 16, wherein a processing temperature of said physical vapor deposition (PVD) is about 320° F. to about 700° F.

23. A method according to claim 22, wherein said nitride layer is zirconium nitride or titanium nitride, and wherein said nitride layer has a Vickers hardness (HV) of at least about 2300.

24. A method according to claim 23, further comprising the steps of securing a handle and clapper assembly to said bell body to form a handbell that can produce a sound corresponding to a note of the musical scale.

* * * * *